US011291877B2

(12) United States Patent
Louis

(10) Patent No.: US 11,291,877 B2
(45) Date of Patent: Apr. 5, 2022

(54) EXERCISE DEVICE

(71) Applicant: Roobens Louis, Temple Terrace, FL (US)

(72) Inventor: Roobens Louis, Temple Terrace, FL (US)

( * ) Notice: Subject to any disclaimer, the term of this patent is extended or adjusted under 35 U.S.C. 154(b) by 0 days.

(21) Appl. No.: 16/940,558

(22) Filed: Jul. 28, 2020

(65) Prior Publication Data

US 2021/0052931 A1 Feb. 25, 2021

Related U.S. Application Data

(60) Provisional application No. 62/890,973, filed on Aug. 23, 2019.

(51) Int. Cl.

| | |
|---|---|
| ***A63B 21/00*** | (2006.01) |
| ***A63B 21/02*** | (2006.01) |
| ***A63B 21/065*** | (2006.01) |
| ***A63B 23/08*** | (2006.01) |
| ***A63B 69/00*** | (2006.01) |

(Continued)

(52) U.S. Cl.

CPC ..... *A63B 21/0004* (2013.01); *A63B 21/02* (2013.01); *A63B 21/0555* (2013.01); *A63B 21/0557* (2013.01); *A63B 21/065* (2013.01); *A63B 21/4011* (2015.10); *A63B 21/4015* (2015.10); *A63B 21/4025* (2015.10); *A63B 21/4047* (2015.10); *A63B 23/085* (2013.01); *A63B 69/0028* (2013.01); *A63B 21/00061* (2013.01); *A63B 21/00065* (2013.01); *A63B 21/04* (2013.01); *A63B 21/0552* (2013.01)

(58) Field of Classification Search

CPC ..... A63B 2209/00; A63B 2071/0694; A63B 21/00058; A63B 21/00061; A63B 21/00065; A63B 21/04; A63B 21/0407; A63B 21/0004; A63B 21/02; A63B 21/0555; A63B 21/0557; A63B 21/0552; A63B 21/065; A63B 21/4011; A63B 21/4015; A63B 21/4047; A63B 21/4025; A63B 23/085; A63B 69/0028

See application file for complete search history.

(56) References Cited

U.S. PATENT DOCUMENTS 4,930,767 A * 6/1990 Hamm ..... A63B 21/0552 482/124

5,860,423 A * 1/1999 Thompson ..... A61F 5/0113 128/882

(Continued)

*Primary Examiner* — Megan Anderson

(74) *Attorney, Agent, or Firm* — DP IP Group; Franco S. De Liguori

(57) ABSTRACT

An exercise device includes a footwear part, a brace part and at least one resistance band. The footwear part has a foot receiving portion configured to receive a front portion of a user's foot. The brace part is configured to be releasably attached to a knee area of the user. The at least one resistance band is configured to be releasably secured at opposite ends thereof to the footwear part and brace part, respectively. The exercise device can be used, among other things, for conditioning and strengthening, for aerobic exercises, and to help individuals maintain proper foot placement throughout an entire exercise and improve their form by helping them stay on their forefoot when performing an exercise dealing with brisk walking or running.

20 Claims, 12 Drawing Sheets

(51) Int. Cl.
*A63B 21/055* (2006.01)
*A63B 21/04* (2006.01)

(56) References Cited

U.S. PATENT DOCUMENTS

| | | | | |
|---|---|---|---|---|
| 8,480,546 | B2 * | 7/2013 | Spencer | A63B 21/0004 482/74 |
| 8,827,873 | B2 * | 9/2014 | Arnstein | A63B 21/4011 482/79 |
| 8,840,530 | B2 * | 9/2014 | Baker | A43B 5/00 482/79 |
| 11,097,142 | B2 * | 8/2021 | Shouhed | A63B 21/0428 |
| 2013/0231227 | A1 * | 9/2013 | Ranieri | A63B 21/00061 482/124 |
| 2019/0201731 | A1 * | 7/2019 | Nguyen | A63B 21/00065 |
| 2020/0276467 | A1 * | 9/2020 | O'Herron | A63B 23/03508 |

* cited by examiner

Fig. F7D

EXERCISE DEVICE

RELATED APPLICATION

This application claims the benefit of U.S. Provisional Patent Application No. 62/890,973, filed on Aug. 23, 2019.

BACKGROUND

Field

The present disclosure relates generally to exercise equipment and, more specifically, to an exercise device in the form of athletic footwear configured for removable attachment to a human foot and knee. The exercise device can be used, among other things, for conditioning and strengthening, for aerobic exercises, and to help individuals maintain proper foot placement throughout an entire exercise and improve their form by helping them stay on their forefoot when performing an exercise dealing with brisk walking or running.

Background Information

There exists a vast array of footwear for use during running, jogging, and brisk walking that are well known. Generally, those footwears are designed to provide comfort and protect the foot. Some known exercise devices of the athletic footwear type also have been designed to attach to an individual's shoe and/or to construct a sole that allows an individual's heel to not touch the ground. However, such exercise devices have been unable to solve problems many individuals deal with when performing brisk walking or running exercises of some sort. Specifically, such exercise devices have been unable to help individuals performing those exercises to have a consistency of staying on their forefoot throughout the entire exercise. Accordingly, such exercise devices are not designed and cannot be effectively used for strength and conditioning workouts and also proper technique form workouts.

In view of the foregoing, there is a need for an exercise device of the athletic footwear type which overcome the foregoing drawbacks of the conventional art.

SUMMARY

It is an object of the present disclosure to provide an exercise device of the athletic footwear type (hereinafter "exercise device") that can be used to help an individual maintain proper foot placement throughout an entire exercise, and that can be used for strength and conditioning as well as proper technique form workout.

Another object of the present disclosure is to provide an exercise device that can help an individual improve their form by helping them stay on their forefoot when performing an exercise dealing with brisk walking or running and during multi-purpose training.

Another object of the present disclosure is to provide an exercise device that will help individuals performing the abovementioned exercises (e.g., brisk walking or running exercises) to have a consistency of staying on their forefoot throughout the entire exercise.

Yet another object of the present disclosure is to provide an exercise device that can be used to effectively build strength and stamina and maintain good posture.

Still another object of the present disclosure is to provide an exercise device that allows the user to run comfortably without risking an injury.

As a further object, the exercise device of the present disclosure is configured to provide runners with great firmness to maintain a front foot land throughout a running exercise, as well as to assist runners to establish good running form.

BRIEF DESCRIPTION OF THE DRAWINGS

The foregoing summary, as well as the following detailed description of preferred embodiments of the disclosure, will be better understood when read in conjunction with the accompanying drawings. For the purpose of illustrating the disclosure, there is shown in the drawings embodiments which are presently preferred. It should be understood, however, that the disclosure is not limited to the precise arrangement and instrumentalities shown.

FIGS. 7A-7F are various views of a brace part of the exercise device shown in FIG. 1, where FIGS. 7A-7C show front, perspective and side views, respectively, of the brace assembled in tubular form depicting its manner of application to the user's knee areas, and FIGS. 7D-7F show perspective, front and top views, respectively, of the brace in an unassembled form prior to being applied to the user's leg/knee area.

FIG. 8A is a side view, FIG. 8B is a perspective view, FIG. 8C is a top view and FIG. 8D is a front view.

FIG. 9A is a side view, FIG. 9B is a front view, FIGS. 9C-9D are different perspective views, and FIG. 9E is a bottom view.

FIG. 10A is a side view, FIG. 10B is a front view, and FIGS. 10C-10D are different perspective views.

DETAILED DESCRIPTION

The present disclosure now will be described more fully hereinafter with reference to the accompanying drawings, in which exemplary embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art.

For convenience of description, the terms "front", "back", "upper", "lower", "top", "bottom", "front", "rear", "right", "left", "side" and words of similar import will have reference to the various members and components of the exercise device of the present disclosure as arranged and illustrated in the figures of the drawings and described hereinafter in detail.

It should also be understood that the terms "about", "approximately," "generally," "substantially" and like terms, which may be used herein when referring to a dimension or characteristic of a component of the present disclosure, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1:
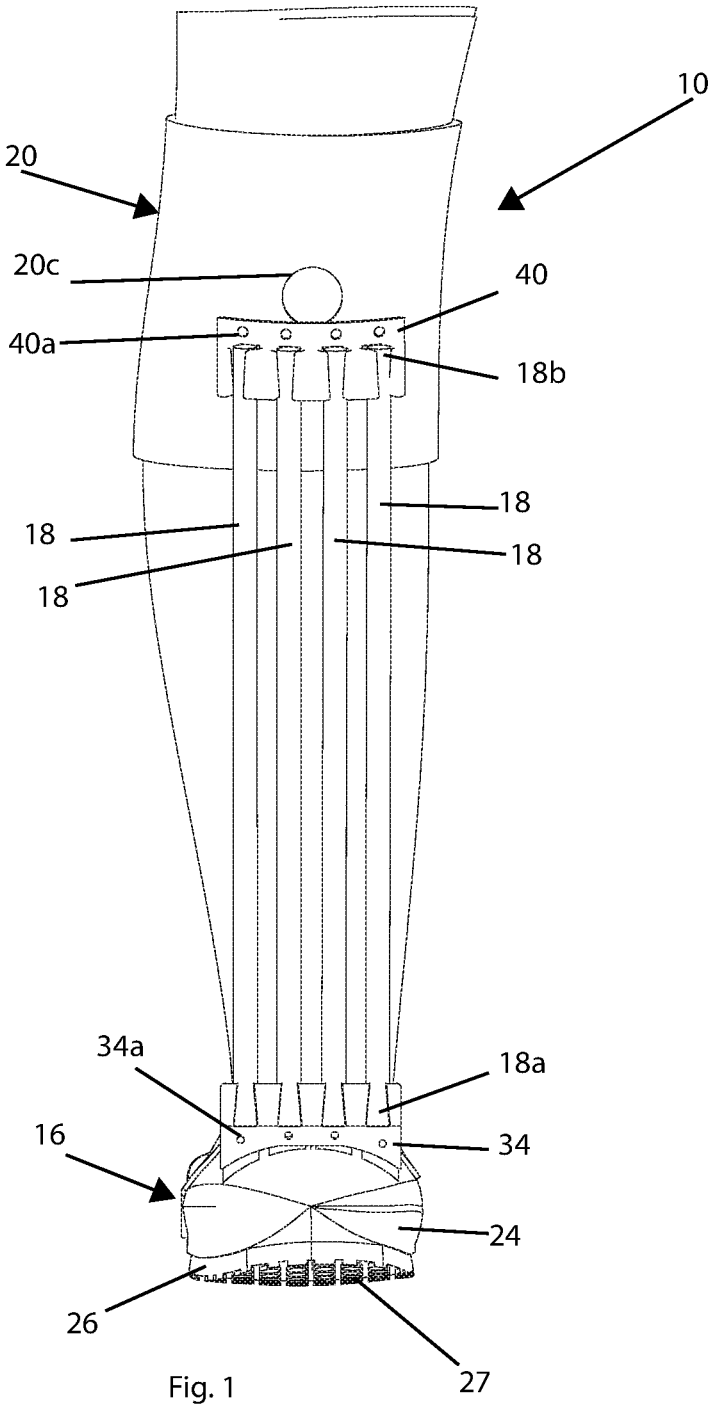
FIG. 1 is a front elevational view of an exercise device according to an embodiment of the present disclosure shown applied to a user's foot and leg.
Figure 2:
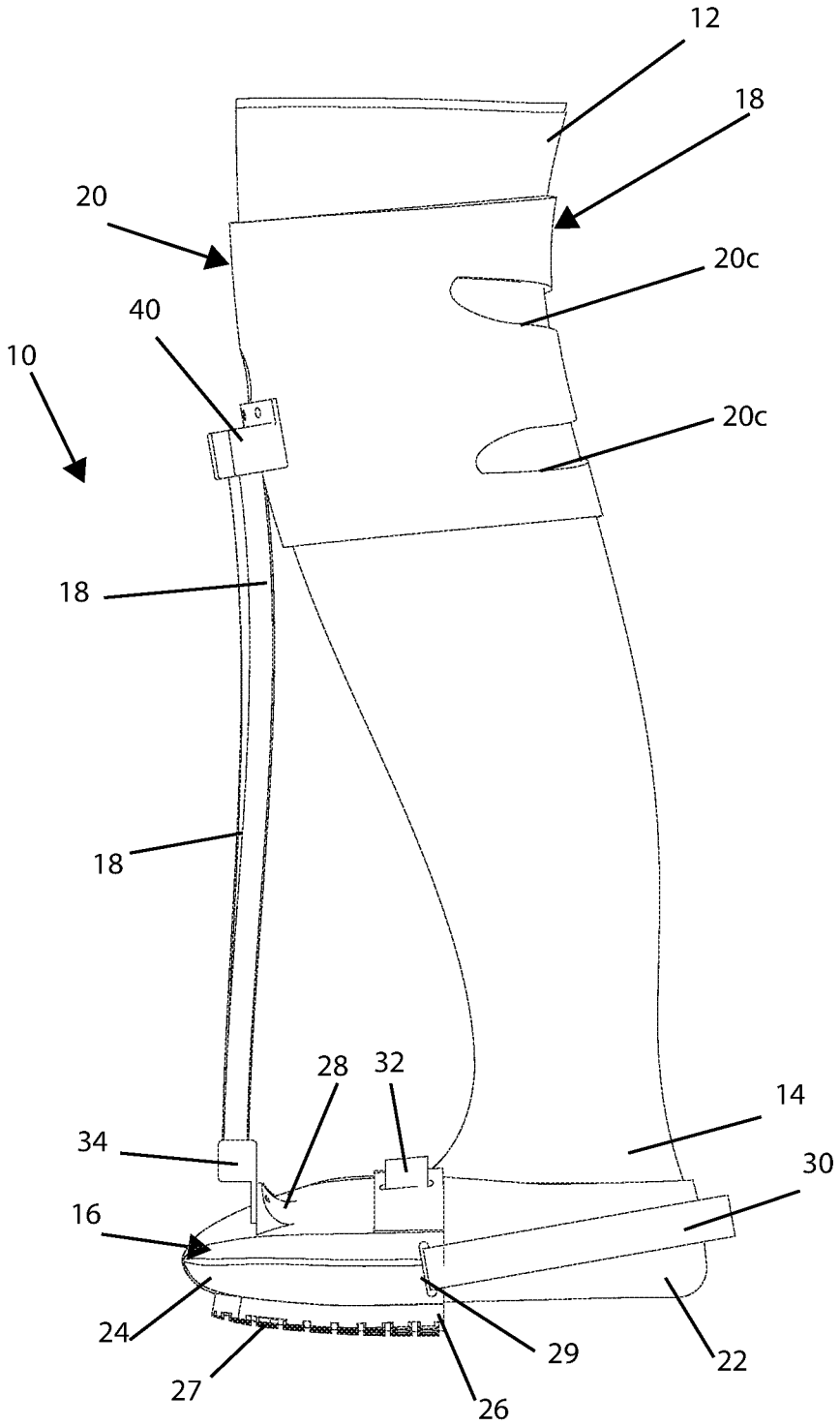
FIG. 2 is a side elevational view of the exercise device shown in FIG. 1.
Figure 3:
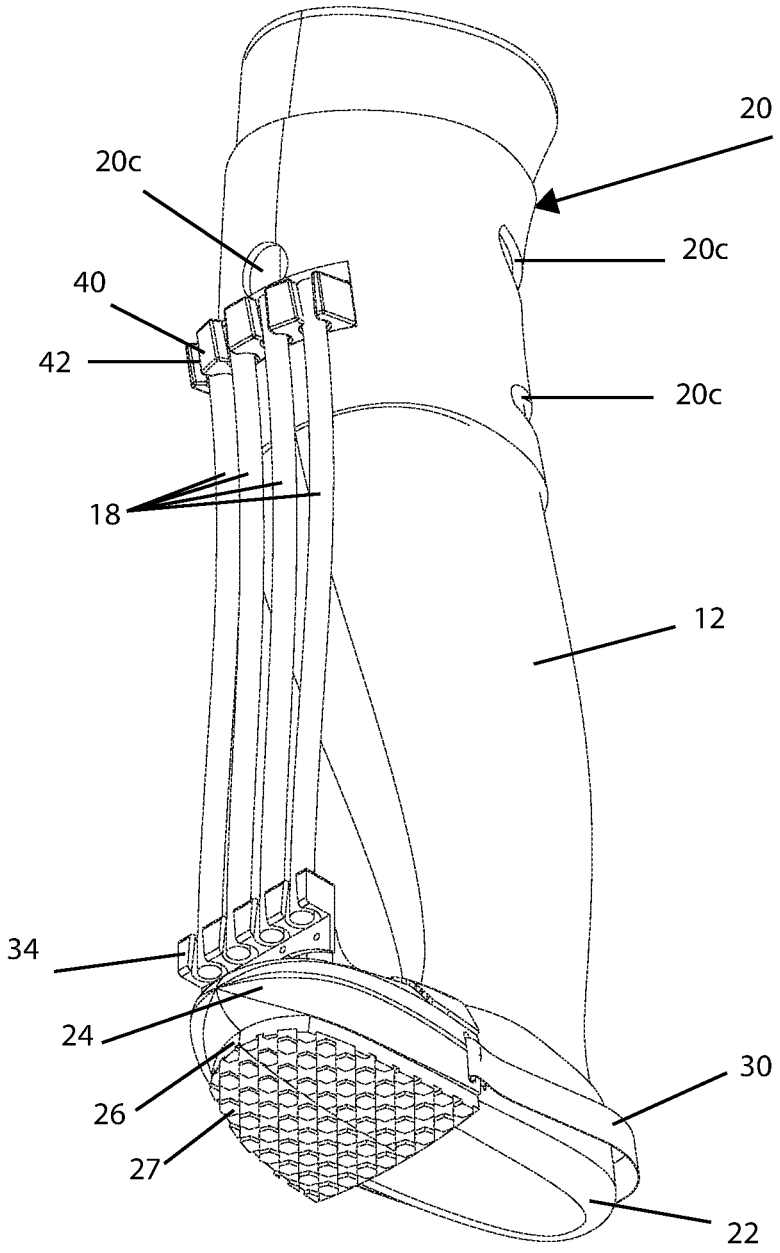
FIG. 3 is a perspective view of the exercise device shown in FIG. 1.
Figure 4:
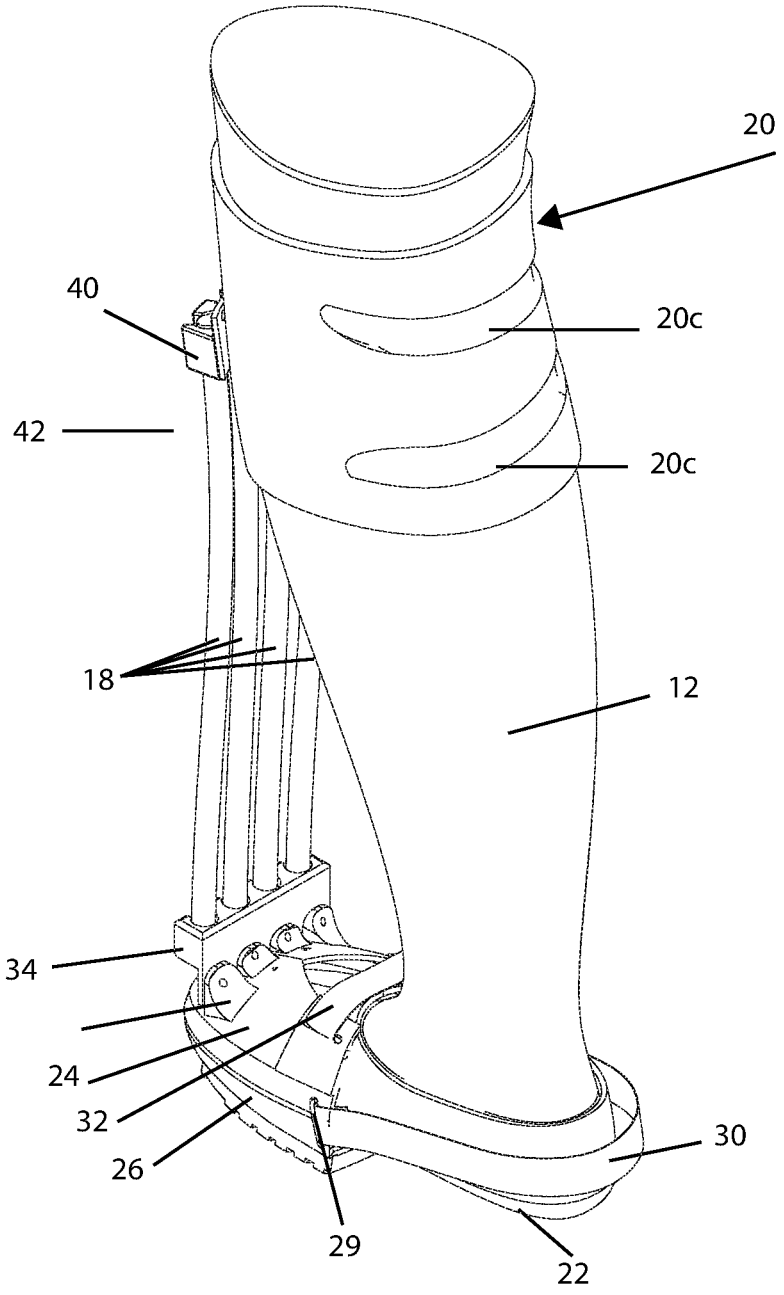
FIG. 4 is another perspective view of the exercise device shown in FIG. 1.
Figure 5:
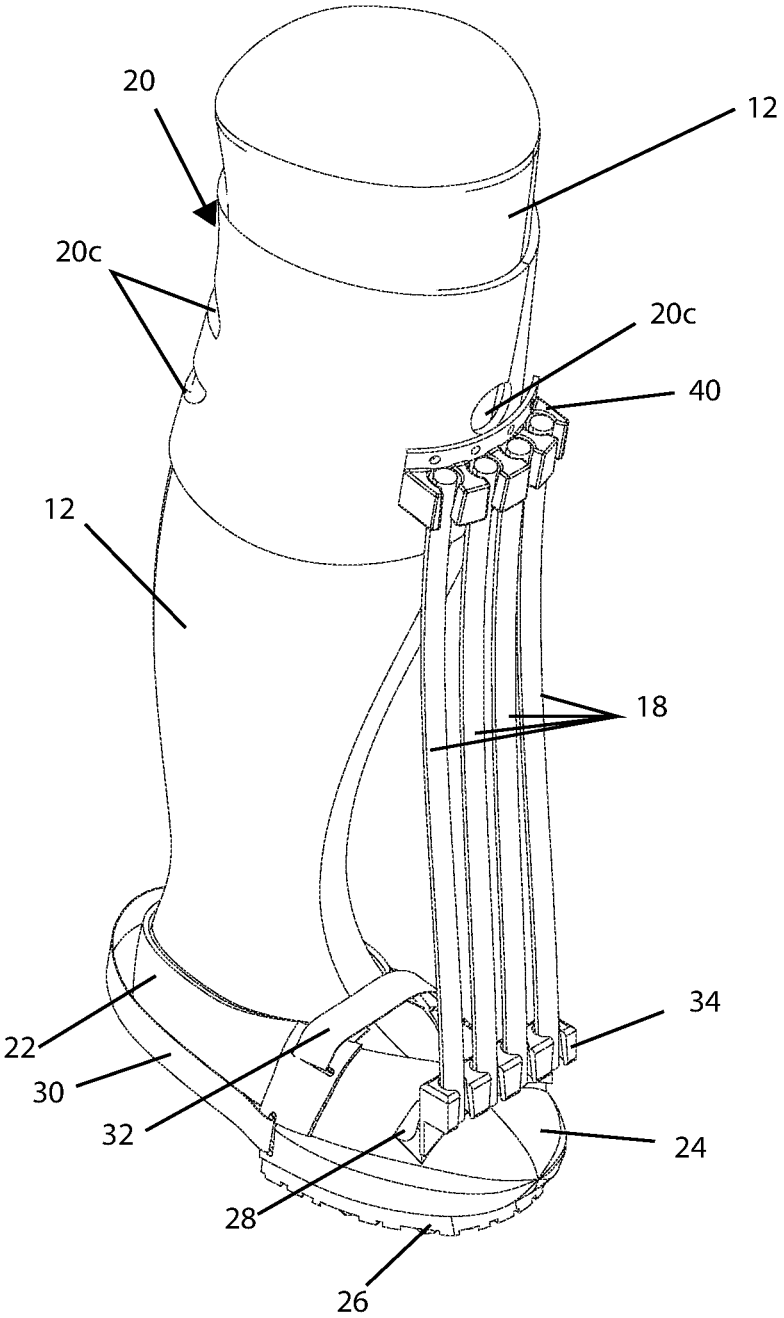
FIG. 5 is another perspective view of the exercise device shown in FIG. 1.
Figure 6:
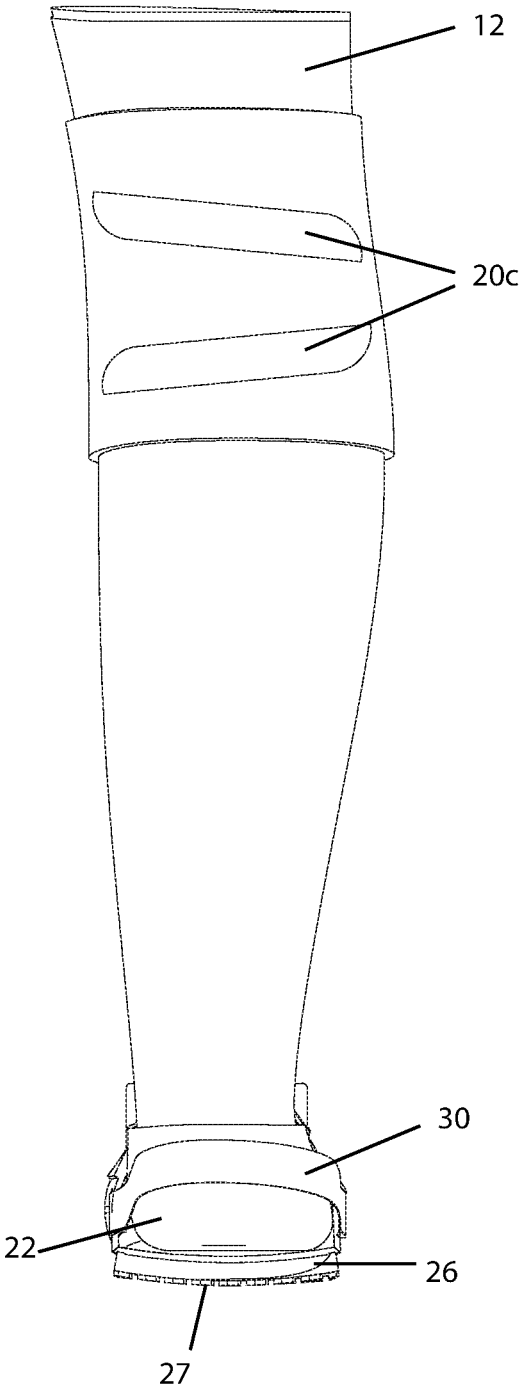
FIG. 6 is a rear view of the exercise device shown in FIG. 1.

Referring to FIGS. 1-6 more particularly by reference character, reference numeral 10 generally designates an exercise device according to an embodiment of the present disclosure shown applied to a user's leg 12 and foot 14 portions. FIGS. 1, 2 and 6 are front, side and rear elevational views and FIGS. 3-5 are different perspective views of exercise device 10 applied on the user's leg and foot portions 12, 14. These figures illustrate how exercise device 10 is applied on the user during use of exercise 10 as further described below.

Exercise device 10 is formed of a footwear part 16, resistance bands 18 and a brace part (knee attachment) 20. As shown in FIGS. 1-6, footwear part 16 is configured to be removably attached to a user's foot wearing an item of footwear 22, brace part 20 is configured to be removably attached to the user's knee areas, and resistance bands 18 are configured for removable connection to and between footwear part 16 and brace part 20. Although not shown, it is understood that footwear part 16 is also configured for removable attachment to an item of footwear (while the footwear item is not being worn by the user) or to a naked human foot without departing from the spirit scope of the present disclosure.

Footwear part 16 is further described below with reference to FIGS. 1-6 and 8A-8D. Footwear part 16 is in the general form of a half of a footwear including a foot receiving portion 24 for receiving a front portion of the user's foot 14, a sole portion 26 with traction elements 27 for contacting the ground, a support member 28 integral with an upper part of receiving portion 24, and securing straps 30, 32 and corresponding buckles 29 or similar structure for releasably and adjustably securing footwear part 16 to the user's foot as shown in the figures. As shown in FIGS. 1-6, footwear part 16 is configured to be placed over and be attached to a user's shoe functioning similar to an insert. Footwear part 16 can be fabricated in different sizes. Based upon a user's initial shoe size, an appropriate size for footwear part 16 will be determined so it can receive a proper insert. Footwear part 16 is configured to have a length that will reach at least the user's midfoot.

Footwear part 16 further includes a lower resistance band holder 34 (first holding member) for releasably holding one end 18*a* of each resistance band 18 in a secured manner. More specifically, holder 34 includes slots 36 for receiving and releasably holding respective ends 18*a* of resistance bands 18 in a secured manner, as best shown in FIGS. 1, 3-5, FIGS. 8B-8C and 11, for example. In this embodiment, holder 34 is fixedly mounted to support member 28 using any suitable fastener 34*a* (e.g., screws, rivets, bolts) extending through corresponding holes in support member 28 and holder 34. Other suitable means for fixedly mounting support member 28 to holder 34, such as stitching and adhesives, may be used without departing from the spirit and scope of the invention.

Figure 7A:
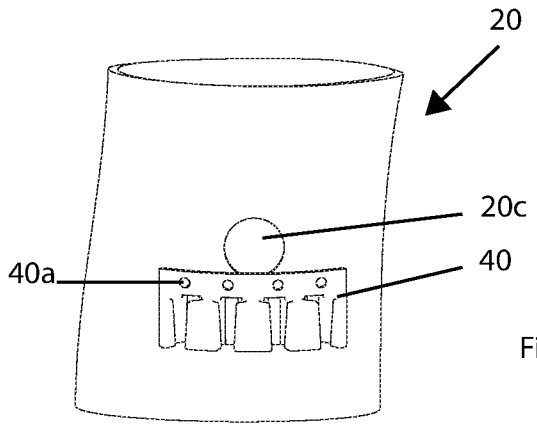
Figure 7B:
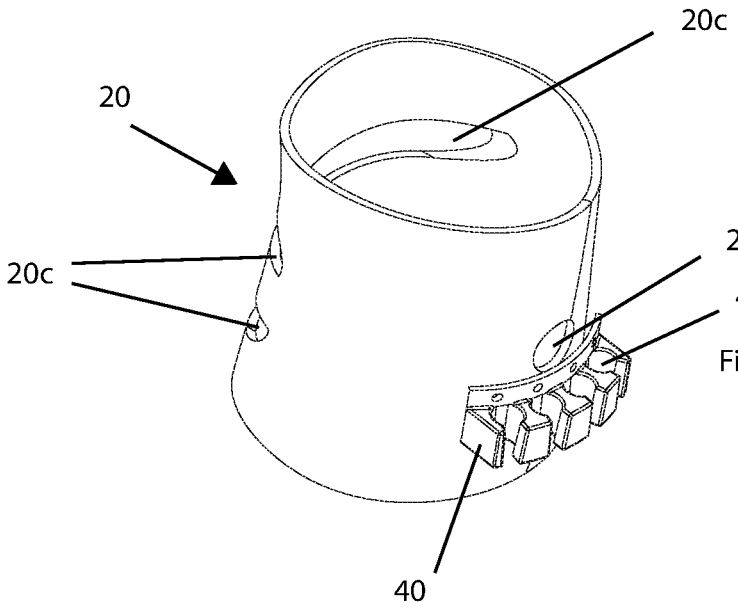
Figure 7C:
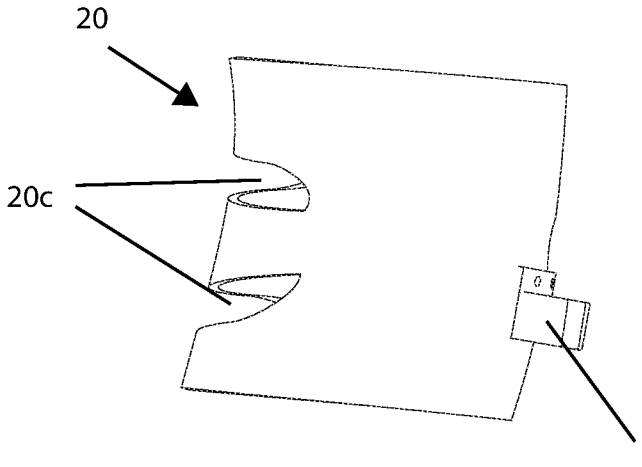
Figure 7E:
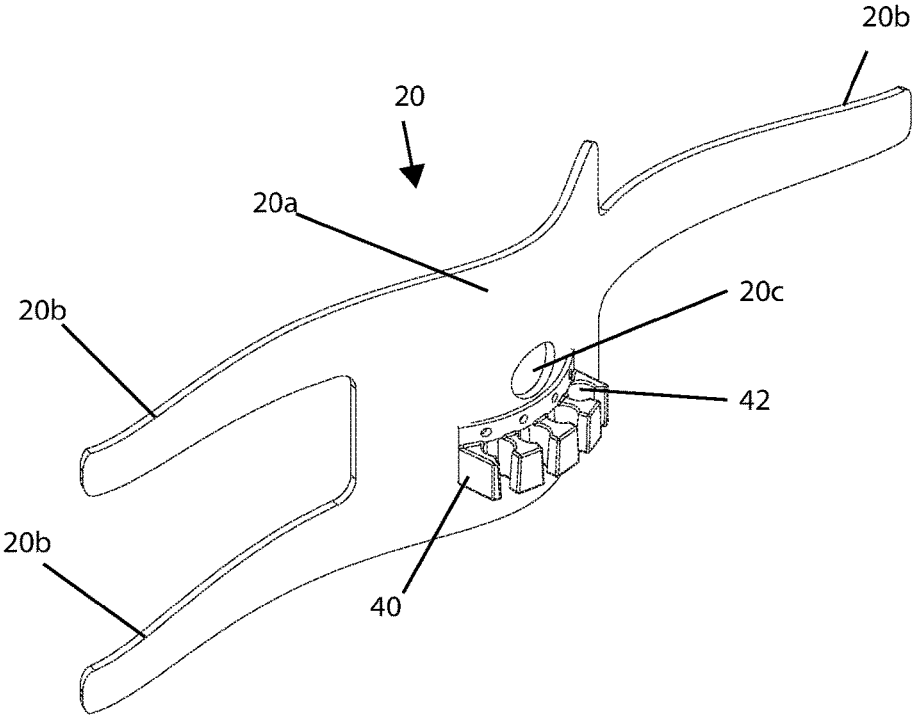
Figure 7E:
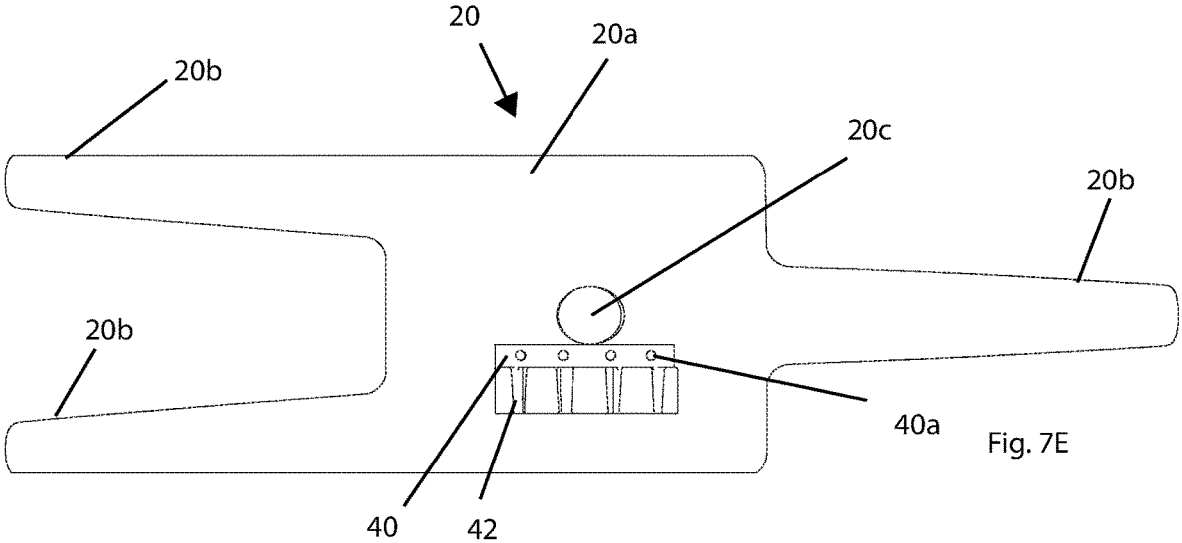
Figure 7F:
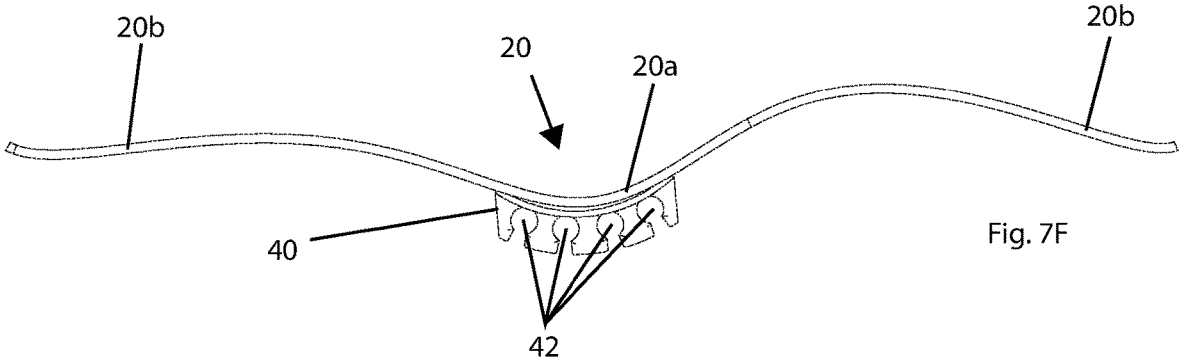
Figure 8A:
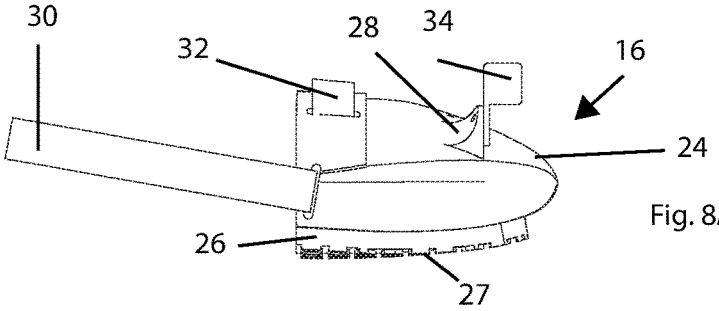
FIGS. 8A-8D are various views of a footwear part of the exercise device shown in FIG. 1, where
Figure 8B:
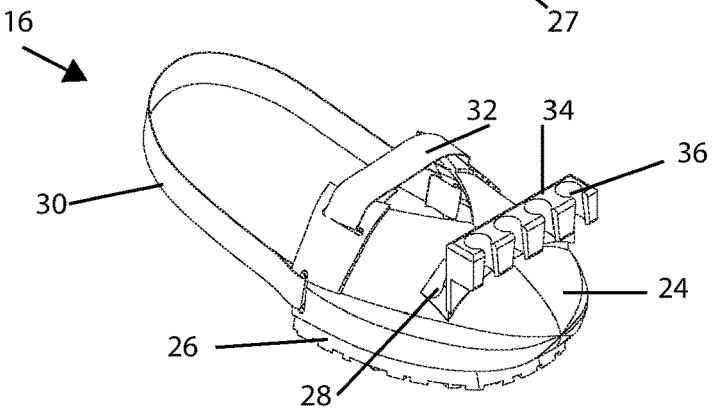
Figure 8C:
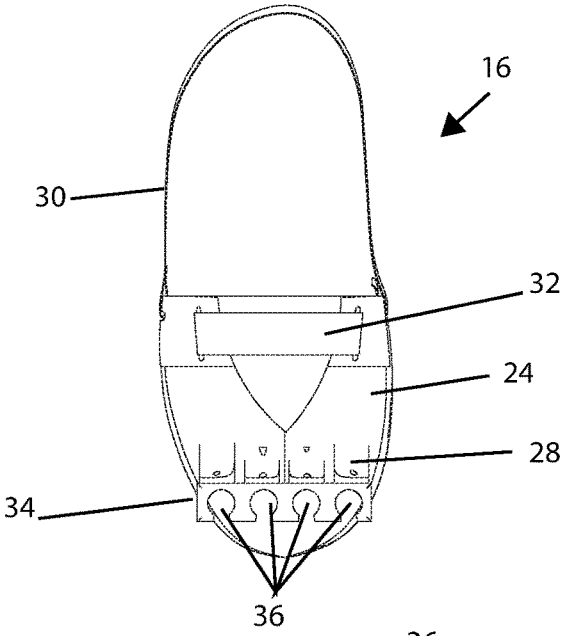
Figure 8D:
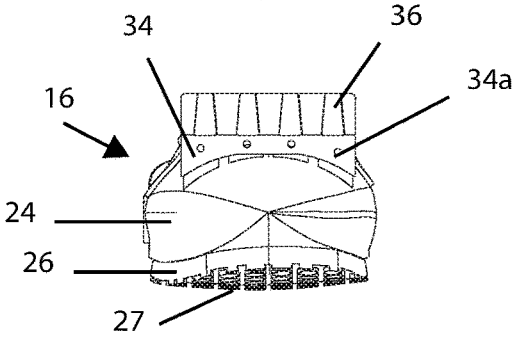
Figure 9A:
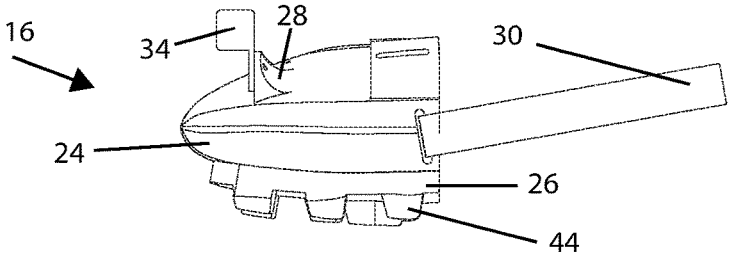
FIGS. 9A-9E are various views showing a modified embodiment of the footwear part of the exercise device shown in FIG. 1, where
Figure 9B:
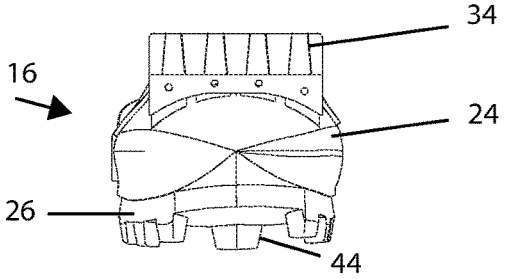
Figure 9C:
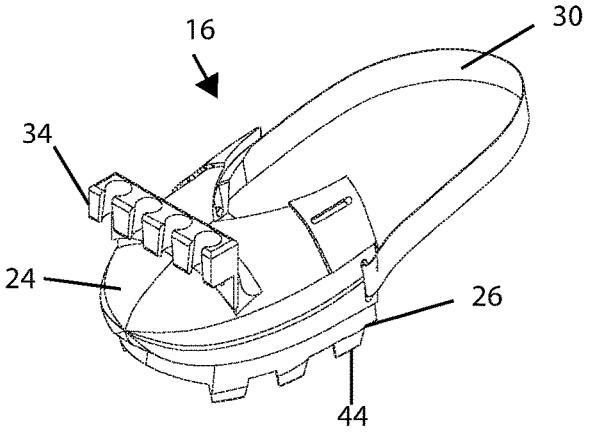
Figure 9D:
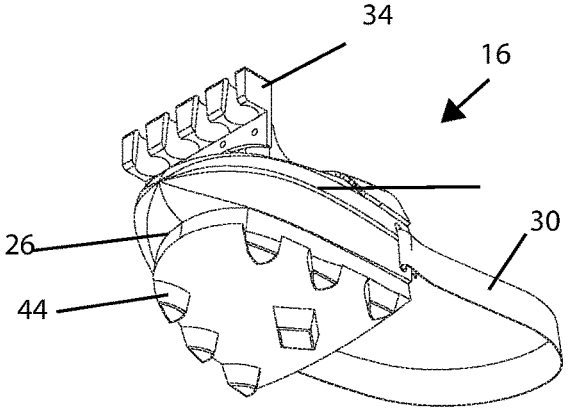
Figure 9E:
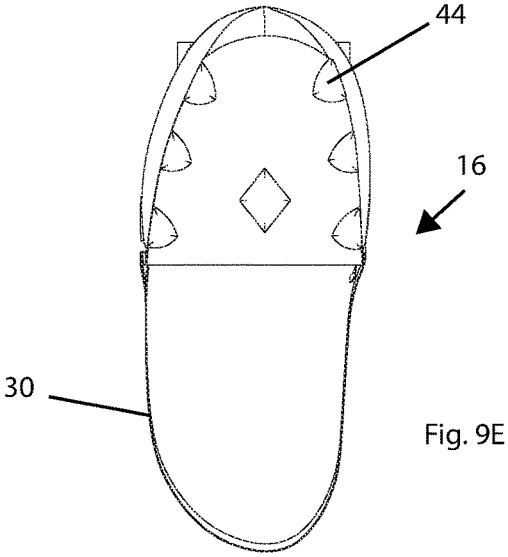
Figure 10A:
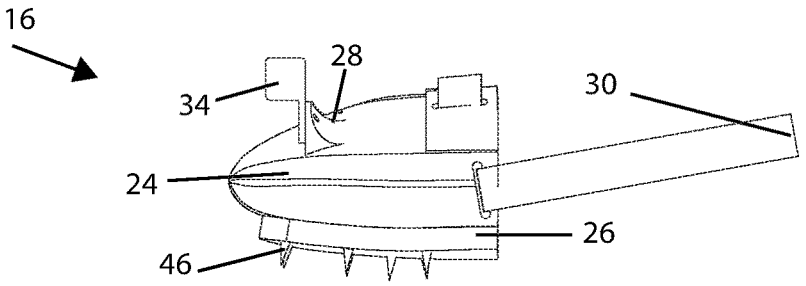
FIGS. 10A-10D are various views showing another modified embodiment of the footwear part of the exercise device shown in FIG. 1, where
Figure 10B:
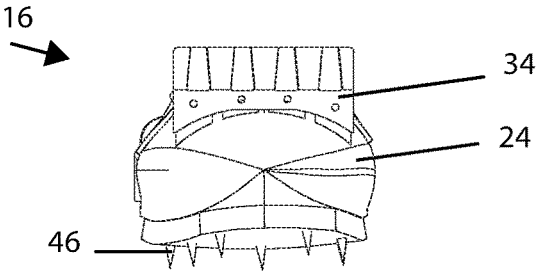
Figure 10C:
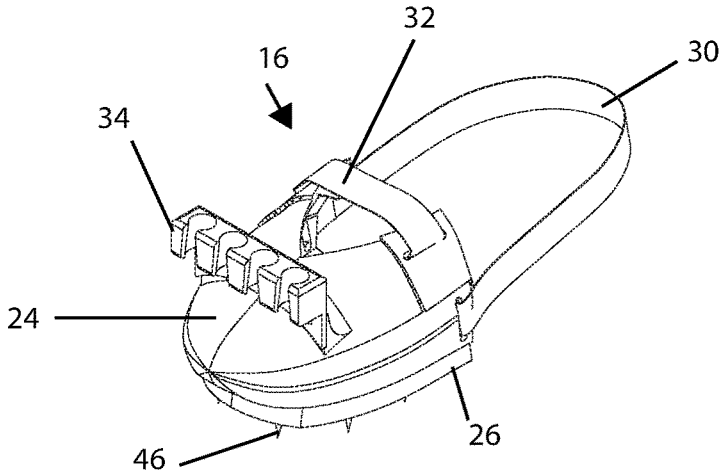
Figure 10D:
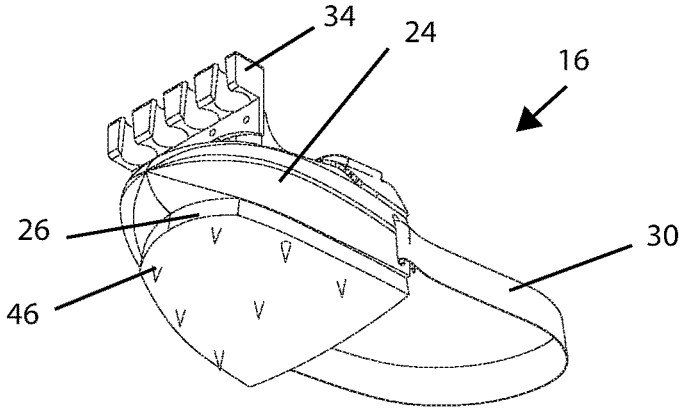

As shown in FIGS. 1-6, brace part 20 is configured for placement and secure attachment to the user's knee area during use of exercise device 10. In this embodiment brace part 20 is formed of a main portion 20*a* and strap portions 20*b* extending from main portion 20*a*, as shown in FIGS. 7D-7F. When attached to the user's knee area, brace part 20 assumes a generally tubular configuration as shown in FIGS. 7A-7C. Brace part 20 includes a number of openings 20*c* in the configuration shown in FIGS. 1-6 and 7A-7C to provide a comfort fit to the user, including aeration, during use of exercise device 10. Additionally, top and bottom portions of brace part 20 may be provided with cushion straps that extend around brace part 20 to hold it in place and provide additional comfort to the user.

Brace part 20 further includes an upper resistance band holder 40 (second holding member) for releasably holding another end 18*b* (opposite to end 18*a*) of each of each resistance band 18 in a secured manner. More specifically, holder 40 includes slots 42 for receiving and releasably holding respective ends 18*b* of resistance bands 18 in a secured manner, as best shown in FIGS. 1 and 3-5, for example. In this embodiment, holder 40 is directly fixedly mounted to brace part 20 using any suitable fastener 40*a* (e.g., screws, rivets, bolts) extending through corresponding holes in holder 40 and brace part 20. Other suitable means for fixedly mounting holder 40 to brace part 20 may be used, such as stitching and adhesives, without departing from the spirit and scope of the invention. In an alternative embodiment, holder 40 may be fixedly mounted to brace part 20 in a manner other than a direct connection to brace part 20, such as via a support member securely mounted to brace part 20.

It will be appreciated that the configuration of brace part 20 is not limited to the one described above for the embodiment shown in FIGS. 7A-7F. Any configuration for brace part 20 is suitable to achieve the objects of the present invention so long as brace part 20 is configured for placement and secure attachment to the user's knee area and for fixedly mounting holder 40 as described above. Likewise, the manner of releasably securing resistance bands 18 to and between footwear part 16 and brace part 20 is not limited to holders 34 and 40 and corresponding structure of footwear part 16 and brace part 20 as described above with reference to the embodiment shown in the figures. Without departing from the spirit and scope of the invention, other means for releasably securing resistance bands 18 to and between footwear part 16 and brace part 20 are suitable so long as resistance bands 18 are firmly secured to footwear part 16 and brace part 20 during use of exercise device 10 while being able to be removed by the user, such as during a resistance band exchange procedure as described above.

Figure 11:
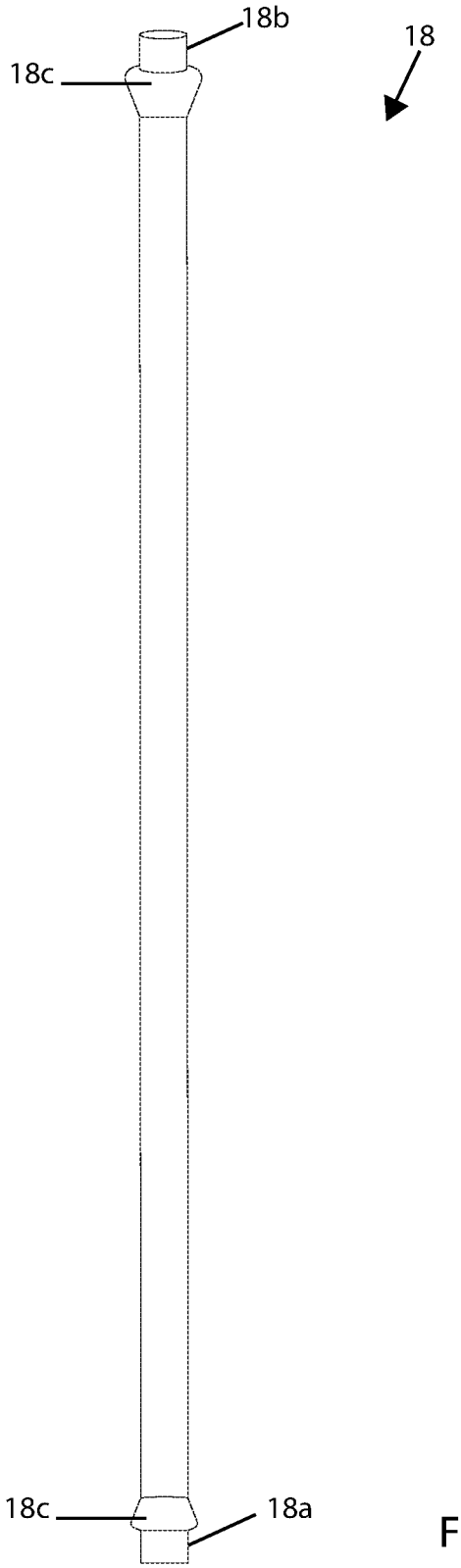
FIG. 11 is a front elevational view showing one of the resistance bands of the exercise device shown in FIG. 1.

FIG. 11 is a front elevational view of the resistance band 18. Resistance band 18 is provided with an enlarged tapered portion or plug 18*c* proximate each corresponding end 18*a*, 18*b* for direct engagement with corresponding slots 36, 42 of holders 34, 40 to releasably and securely hold resistance bands 18 in the configuration shown in FIGS. 1-5 during use of exercise device 10. Plugs 18*c* are formed with a size slightly greater than the inner circumference of slots 36, 42 so that plugs 18*c* are securely wedged into slots 36, 42 so that each resistance band is securely held by footwear part 16 and brace part 18 during use of exercise device 10, while allowing resistance band 18 to be removed for replacement, for example, as described above.

According to the present disclosure, resistance bands 18 can be provided with different resistance levels so that users of exercise device 10 will be able to program the difficulty of their workout by mixing and interchanging resistance bands 18 of different resistance levels as desired. Additionally, resistance bands may be color-coded by weight (e.g., approximately 10 lbs-100 lbs) for quick resistance level identification during interchange. In one embodiment, each resistance band has a length in the range of approximately 0.5 feet to approximate 4 feet to accommodate exercising for everyone from beginners to advance users of exercise device 10. It is understood, however, that the appropriate length for the resistance bands is selected with the goal of accommodating the user of exercise device 10.

From the foregoing construction, it is appreciated that resistance bands 18 are securely attached to and retained in place between footwear part 16 and brace part 20 during use of exercise device 10, as shown in FIGS. 1-5. This is effectively accomplished by slots 36 of holder 34 which receive and releasably hold ends 18*a* of resistance bands 18 and slots 42 of holder 40 which receive and releasably hold opposite ends 18*b* of resistance bands 18, as described above. This structural and positional configuration permits resistance bands 18 to be held generally straight in place, as shown in FIGS. 1-5, so that resistance bands 18 do not touch the user's knee while performing an activity during use of exercise device 10. Furthermore, while in the embodiment of exercise device 10 described above holders 34 and 40 are provided with four slots 36 and 42 each for supporting a corresponding number of resistance bands, it will be appreciated that the number of slots and corresponding number of resistance bands may be varied without departing from the spirit and scope of the present disclosure. Likewise, while the embodiment of exercise device 10 shown in the figures contains four resistance bands secured to holders 34, 40, it is understood that a user may elect to use any number of resistance bands 18 greater or less than four depending on the particular desired exercise and/or exercise intensity, so long that at least one resistance band 18 is utilized to achieve the desired results when using exercise device 10.

According to the present disclosure, footwear part 16 may be provided with various types of designs for sole portion 26 to correlate to certain sports and activities. Such sole member designs may be structured for indoor and/or outdoor use as desired. For example, in the embodiment of footwear 16 shown in FIGS. 1-6 and 8A-8D, traction elements 27 provided on sole portion 26 of footwear part 16 are configured for indoor or outdoor use, such a found in conventional walking or running athletic footwear. FIGS. 9A-9E and 10A-10D show alternative embodiments of footwear part 16 according to the present disclosure. Footwear parts 16 shown in FIGS. 9A-9E and 10A-10D have the same construction as footwear part 16 described above with reference to FIGS. 1-6 and 8A-8D, except for the traction elements of sole portion 26 as further described below.

In footwear part 16 shown in FIGS. 9A-9E, sole portion 26 has traction elements 44 in the form of cleats, making such footwear part suitable for use by individuals that are training in football, soccer or lacrosse, for example. Footwear part 16 may be configured with different cleats designs and structure to align with recommendations for the particular sport. In footwear part 16 shown in FIGS. 10A-10D, sole portion 26 has traction elements 46 in the form of spikes, making such footwear part suitable for use by individuals on a track during training in track and field, for example. In other embodiments, the sole member and corresponding traction elements of footwear part 16 may be designed for indoor and/or outdoor use as deemed suitable for the specific use.

Various materials may be used for the components of exercise device 10 according to the present disclosure. For example, foot receiving portion 24 of footwear part 16 is preferably made of a hard rubber material so as to be able to securely support holder 34 as described above. In this embodiment, support member 28 to which holder 34 is securely attached is preferably molded in one piece with foot receiving portion 24 in order to increase the securing strength of holder 34 and corresponding resistance bands 18. Alternatively, support member 28 may be formed separately from foot receiving portion 24 and securely connected thereto using suitable connecting means. The materials for other portions of footwear part 16, including sole portion 26 and straps 30, 32, include, but not limited to, textiles, synthetics, rubber, foam, polyurethane, polyvinyl chloride compound (PVC) and ethylene-vinyl acetate (EVA). Holders 34 and 40 may be made of a suitable plastic or metal material. Main portion 20*a* and strap portions 20*b* of brace part 20 may be made a suitable rubber, foam or fabric material, or a combination thereof. Resistance bands 18 may be selected from any commercially available resistance bands used for resistance training, such as the resistance cables sold by Lifeline Products LLC.

To use exercise device 10 of the present disclosure, straps 30, 32 of footwear part 16 may be sufficiently loosened or unfastened and the user's foot portion 14, including footwear 22 is inserted into foot receiving portion 24, as shown in FIGS. 1-6. Straps 30, 32 are then tightened and fastened as also shown in FIGS. 1-6. Thereafter, or before applying footwear part 16 as described above, brace part 20 is applied to the user's knee area by securing main portion 20*a* and strap portions 20*b* of brace part 20 together to achieve the tubular configuration of brace part 20 as shown in FIGS. 1-6 and 7A-7C. After footwear part 16 and brace part 20 are securely applied to the user as set forth above, the selected number of resistance bands 18 are interconnected between footwear part 16 and brace part 20 as shown in FIGS. 1-6. Specifically, opposite ends 18*a*, 18*b* of resistance bands 18 are inserted into corresponding slots 36, 42 of holders 34, 40, respectively, until the corresponding plugs 18*c* are wedged in place within slots 36, 42 to securely connect resistance bands to footwear part 16 and brace part 20. After donning exercise device 10 in the manner described above, various exercises or training regimens can be conducted, such as described herein.

The exercise device disclosed herein is particularly designed, configured and adapted to help an individual maintain proper foot placement throughout an entire exercise and can be used for strength and conditioning as well as proper technique form workout. The exercise device is also able to help an individual improve their form by helping them stay on their forefoot when performing an exercise dealing with brisk walking or running and during multipurpose training. Furthermore, the exercise device will help any individuals that are performing the abovementioned exercises (e.g., brisk walking or running exercises) to have a consistency of staying on their forefoot throughout the entire exercise.

Moreover, the exercise device according to the present disclosure can be used to effectively build strength and stamina and maintain good posture, allows the user to run comfortably without risking an injury, and provides runners with a great firmness to maintain a front foot land throughout a running exercise as well as assist runners to establish a good running form.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but are to be accorded the widest scope consistent with the principles and novel features disclosed herein.

What is claimed is:

1. An exercise device comprising:

a footwear part in the general form of a half of a footwear having a foot receiving portion configured to receive a front portion of a user's foot so as to prevent a heel portion of the user's foot from contacting a ground surface during use of the exercise device;

a brace part configured to be releasably attached to a knee of the user; and at least one resistance band configured to be releasably secured at opposite ends thereof to the footwear part and brace part, respectively.

2. The exercise device according to claim 1, further comprising a first holder securely attached to the footwear part and configured to removably hold in a secured manner one of the opposite ends of the at least one resistance band, and a second holder securely attached to the brace part and configured to removably hold in a secure manner the other of the opposite ends of the at least one resistance band.

3. The exercise device according to claim 2, wherein the at least one resistance band comprises a plurality of resistance bands; and wherein the first and second holders are configured to removably hold the respective opposite ends of the plurality of resistance bands.

4. The exercise device according to claim 3, wherein the opposite ends of each of the plurality of resistance bands are received in respective slots formed in the first and second holders.

5. The exercise device according to claim 2, wherein the opposite ends of the at least one resistance band are received in respective slots formed in the first and second holders.

6. The exercise device according to claim 1, wherein the at least one resistance band comprises a plurality of resistance bands; and further comprising first and second resistance band holders configured to releasably secure and hold the plurality of resistance bands at first and second opposite ends thereof to the footwear part and the brace part, the first resistance band holder being connected to the footwear part and having a plurality of slots for receiving and releasably holding respective first opposite ends of the plurality of resistance bands, and the second resistance band holder being connected to the brace part and having a plurality of slots for receiving and releasably holding respective second opposite ends of the plurality of resistance bands.

7. The exercise device according to claim 6, wherein the first resistance band holder is connected to a front of the footwear part; and wherein the second resistance band holder is connected to a front of the brace part.

8. The exercise device according to claim 6, further comprising a support member formed in one piece with the footwear part for removably supporting the first resistance band holder.

9. The exercise device according to claim 1, wherein the footwear part has a sole portion with traction elements.

10. The exercise device according to claim 9, wherein the traction elements comprise one of cleats or spikes.

11. The exercise device according to claim 1, wherein the at least one resistance band comprises a plurality of resistance bands.

12. The exercise device according to claim 1, wherein the footwear part has a plurality of securing straps configured for releasably securing the foot receiving portion to the user's foot.

13. The exercise device according to claim 1, wherein the foot receiving portion is configured to receive an item of footwear while being worn on the user's foot.

14. The exercise device according to claim 1, wherein the at least one resistance band extends from a front of the brace part to a front of the footwear part.

15. The exercise device according to claim 1, wherein the at least one resistance band comprises a plurality of resistance bands disposed adjacent one another and extending from a front of the brace part to a front of the footwear part.

16. An exercise device comprising:

a footwear part in the general form of a half of a footwear configured to receive only a forefoot to midfoot of a user's foot so as to prevent a heel portion of the user's foot from contacting a ground surface during use of the exercise device;

a brace part configured to be releasably attached to a knee of the user;

a plurality of resistance bands; and securing means for releasably securing the plurality of resistance bands at first and second opposite ends thereof to the footwear part and brace part, respectively.

17. The exercise device according to claim 16, wherein the securing means comprises a first resistance band holder attached to the footwear part and a second resistance band holder attached to the brace part, the first resistance band holder having a plurality of slots for receiving and releasably holding respective first opposite ends of the plurality of resistance bands, and the second resistance band holder having a plurality of slots for receiving and releasably holding respective second opposite ends of the plurality of resistance bands.

18. The exercise device according to claim 17, further comprising a support member extending from the footwear part for removably supporting the first resistance band holder.

19. The exercise device according to claim 18, wherein the support member is formed in one piece with the footwear part.

20. The exercise device according to claim 17, wherein the first resistance band holder is attached to a front of the footwear part and the second resistance band holder is attached to a front of the brace part.

* * * * *